US008485012B2

(12) United States Patent
Hermann et al.

(10) Patent No.: US 8,485,012 B2
(45) Date of Patent: Jul. 16, 2013

(54) COLD ROLLING METHOD FOR MANUFACTURING A PROFILE

(75) Inventors: Fritz Hermann, Landsberg (DE); Juergen Gebhard, Altstaetten (CH); Christoph Wiedner, Feldkirch (AT); Erwin Karle, Aitern (DE); Frank Bertram, Rickenbach (DE); Frank Jackel, Köln (DE)

(73) Assignee: Hilti Aktiengesellschaft, Schaan (LI)

( * ) Notice: Subject to any disclaimer, the term of this patent is extended or adjusted under 35 U.S.C. 154(b) by 767 days.

(21) Appl. No.: 12/322,365

(22) Filed: Jan. 30, 2009

(65) Prior Publication Data

US 2009/0205390 A1 Aug. 20, 2009

(30) Foreign Application Priority Data

Feb. 1, 2008 (DE) ..... 10 2008 000 219

(51) Int. Cl.
*B21B 15/00* (2006.01)

(52) U.S. Cl.
USPC ..... 72/177; 72/234; 72/180

(58) Field of Classification Search
USPC ..... 72/179–181, 197, 226, 234, 166, 72/177, 167
See application file for complete search history.

(56) References Cited

U.S. PATENT DOCUMENTS

| | | | | |
|---|---|---|---|---|
| 3,209,432 | A | 10/1965 | Cape | |
| 3,850,019 | A * | 11/1974 | Bray et al. | 72/199 |
| 4,770,018 | A * | 9/1988 | Bosl et al. | 72/177 |
| 4,876,837 | A * | 10/1989 | Kelly et al. | 52/287.1 |
| 4,962,622 | A * | 10/1990 | Albrecht et al. | 52/630 |
| 4,969,346 | A * | 11/1990 | Bosl et al. | 72/177 |
| 6,237,384 | B1 * | 5/2001 | Seidel | 72/201 |
| 6,282,937 | B1 * | 9/2001 | Michaud | 72/178 |
| 7,254,977 | B2 * | 8/2007 | Machrowicz et al. | 72/342.3 |
| 2002/0124616 | A1 * | 9/2002 | Hallenstvet et al. | 72/177 |
| 2004/0011109 | A1 * | 1/2004 | Hall et al. | 72/234 |
| 2007/0248793 | A1 * | 10/2007 | Herb et al. | 428/122 |

FOREIGN PATENT DOCUMENTS

| | | |
|---|---|---|
| DE | 3343-709 | 6/1984 |
| DE | 10113610 | 10/2002 |
| DE | 102007051354 | 10/2008 |
| EP | 1847334 | 10/2007 |
| JP | 61027103 | 6/1986 |

* cited by examiner

*Primary Examiner* — Dana Ross
*Assistant Examiner* — Homer Boyer
(74) *Attorney, Agent, or Firm* — Abelman, Frayne & Schwab

(57) ABSTRACT

A cold rolling method for manufacturing a profile (16) from a one-piece rolling stock in form of initial material (6; 56) with a plurality of rolls (26, 36, 46; 6, 76, 86) each having a deforming region (28, 38, 48; 68, 78, 88) for deforming the initial material (6; 56) includes bending the initial material (6; 56) with formation at least one folded section (8) extending in a rolling direction of the initial material (6; 56), and deforming the initial material (6; 56) in its width direction with reduction of its thickness at least in one region.

5 Claims, 3 Drawing Sheets

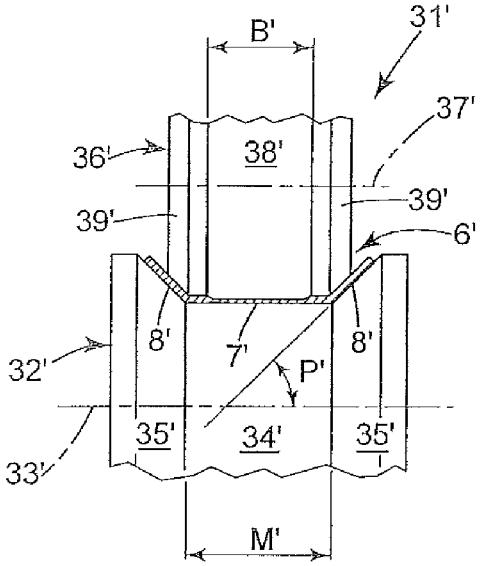
FIG. 4A
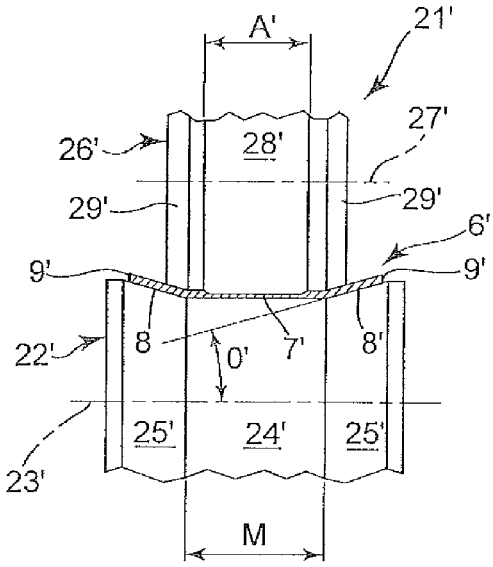
FIG. 4B
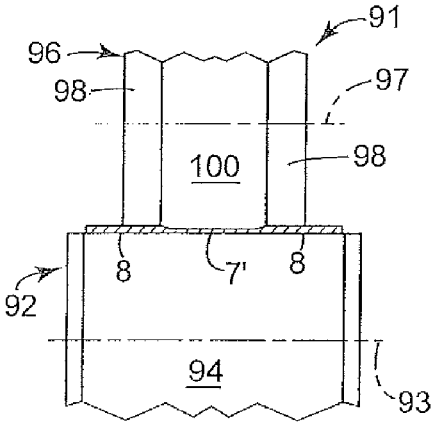
FIG. 4C
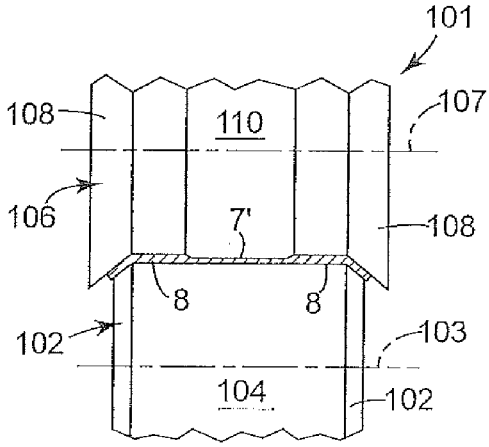
FIG. 4D
FIG. 5
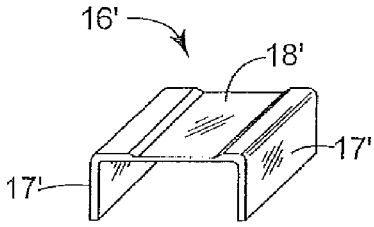

COLD ROLLING METHOD FOR MANUFACTURING A PROFILE

BACKGROUND OF THE INVENTION

1. Field of the Invention

The present invention relates to a cold rolling method for manufacturing a profile from a one-piece rolling stock in form of initial material with deforming regions of rolls which serve for deformation of the initial material.

2. Description of the Prior Art

Under a cold rolling process, one skilled in the art understands a process of deforming a one-piece rolling stock at a temperature below its recrystallization temperature with rolls.

Profiles produced from a rolling stock can have different shapes. With material-intensive profiles such as, e.g., C-shaped mounting rails, a main portion of the manufacturing costs in the cost of the material. Therefore, saving of the material results in a significant reduction of the manufacturing costs.

For structural reasons, a profile need not necessarily have a constant thickness, material thickness, over its circumference. Therefore, the less loaded sections of the profile can have a reduced thickness, which leads to saving of material.

A partial reduction of thickness by a single-step rolling, in a cold rolling process, of a strip-shaped rolling stock does not make sense. This is because of friction in a direction transverse to the roll and the stiffness of the flat rolling stock, the reduction of material is converted only into stretching in the longitudinal displacement direction and into hardening of the material. This leads to inner stresses and a noticeable wrapping of the rolling stock.

European Patent EP 0 259 479 B1 discloses a cold rolling process according to which an initial material is rolled in a plurality of stations between rotatable mandrels and rotatable pressure rolls which have, respectively, deforming regions inclined to a rotational axis of the rolls, whereby the thickness of the initial material is reduced, and the initial material widens in the direction of inclinations of the deforming regions. The reduction of thickness during the cold rolling process disclosed in the above-discussed European patent is analogous to that during a deep drawing process.

The drawback of the method or process, which was discussed above, consists in that the process enables a reduction of the number of necessary rolling stations in the rolling installation for forming a profile only for profiles having a trapezoidal cross-section.

Because of the inclination of the deforming regions, the pressure rolls have, in their deforming regions, different working diameters, which leads to wear and, thus, to undesirable marks in the profile.

Accordingly, an object of the present invention is a cold rolling process which would insure an improved widening of a one-piece rolling stock and an improved economic efficiency of the process.

SUMMARY OF THE INVENTION

This and other objects of the present invention, which will become apparent hereinafter, are achieved by providing a cold rolling method or process for manufacturing a profile from a one-piece rolling stock in form of an initial material and including providing a plurality of rolls each having a deforming region for deforming the initial material; bending the initial material with formation at least one folded section extending in a rolling direction of the initial material; and deforming the initial material in a width direction of the initial material with reduction of thickness thereof at least in one region.

With at least one folded section, there is formed in the initial material at least one bend, whereby there is produced, in the initial material or in the one-piece rolling stock, a further edge extending in the rolling or longitudinal direction. The further edge is spaced from a free edge of the one-piece rolling stock, which extends in the rolling or longitudinal direction, by a distance smaller than its distance from a to-be-formed thickness-reduced region. As a result, at reduction of thickness with a multi-step cold rolling process, a comparatively greater widening is achieved with the same number of stations of a rolling installation.

Instead of the separate counter-roll for each roll with a deforming region in each rolling station, a counter-support can be formed by a table extending in a plane that extends parallel to the rotational axis of the rolls, or be formed by a large counter-roll the rotational axis and at least one region of the outer surface of which extend parallel to the rotational axis of rolls with deforming regions. Widening of the one-piece rolling stock can be also effected with two opposite rolls each having a deforming region, with the deforming regions of the two rolls facing each other.

Advantageously, a number of folded sections or a number of bends which are provided at predetermined locations on the initial material, corresponds to the number of bends necessary for producing a desired profile. The reduction of thickness in corresponding sides is effected between two bends or between a bend and a free edge of the initial material. When a deformed profile should have several thickness-reduced sections or regions, these regions are preferably formed simultaneously. Alternatively, the thickness reduction of separate regions is effected consequently, one after another in several rolling steps.

Advantageously, bending of the initial material is effected in the first process step and then the deformation of the initial material in its width direction takes place. Thereby, at least one bend is provided before widening of the initial material. Firstly, the initial material is deformed to a predetermined shape, e.g., with profiling rolls which, e.g., have essentially the final shape corresponding to the shape of a to-be-produced profile, and then the thickness in the desired sections of the initial material is reduced with rolls having deforming regions.

According to another embodiment of the inventive method, bending of the initial material and its deformation in the width direction is effected simultaneously. The at least one folded section or bend is formed during widening, at least by the start of the widening of the initial material. This permits to reduce the number of necessary stations of the rolling installation for producing a profile. Bending and deformation is advantageously carried out at least in the initial phase of a multi-step cold rolling process. Advantageously, in each station of the rolling installation, there is provided a roll having a deforming region and an opposite counter-roll having a bearing region and at least one support region that retains the initial material in a position and provides for formation of at least one bend in the initial position.

Advantageously, deformation of the initial material in its width direction is effected with sidewise offset deforming regions of following each other, in the rolling direction of the initial material, rolls. The deforming regions of the rolls, which are offset in the transverse direction and penetrate in the initial material, advantageously insure that deformation of the initial material takes place only in the width direction even when a multi-step cold rolling process is used. The widening of the initial material can be effected on one or both sides in a direction parallel to the width direction of the initial material.

Advantageously, the initial material is bent into the profile that has a desired shape, stepwise from a roll to a roll. This insures a simple manufacturing of the profile with a small number of necessary stations of the rolling installation, without producing a substantial stresses in the initial material.

Advantageously, in a further step of the cold-rolling process, bending back of the at least one folded section is effected before further formation of the deformed and bent initial material in the profile. The bend, which is produced by bending back of the at least one folded section before or during the thickness reduction, serves, during a multi-step cold rolling process, simply as an auxiliary bend and is again restored before forming the thickness-reduced initial material in a desired profile. The auxiliary bend provides, during the reduction of thickness, for an advantageous widening of the initial material and simultaneously insures a large flexibility in shaping the cross-section of the profile during manufacturing of the profile.

Advantageously, the deformation regions of the rolls penetrate to the same depth in the initial material. As a result, there is produced, in the width direction, i.e., transverse to the displacement direction or to the rolling direction, between the thickness-reduced sections and thickness-non-reduced sections, only homogenous inclined transition regions of the thickness and which have a very small expansion transverse to the displacement direction. In addition, the thickness-reduced section(s) of the initial material has(ve) advantageous surface characteristics.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIGS. 4A-4D schematic views of four, following one another further separate steps of a third embodiment of a cold rolling method according to the present invention; and FIG. 5 a perspective view of a profile produced with the cold rolling method described with reference to FIGS. 4A-4C.

DETAILED DESCRIPTION OF THE PREFERRED EMBODIMENTS

Figure 1A:
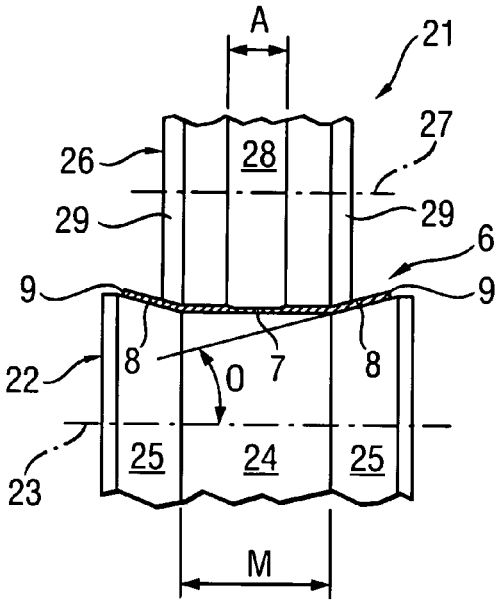
FIGS. 1A-1C schematic views of three, following one another separate steps of a first embodiment of a cold rolling method according to the present invention.
Figure 1B:
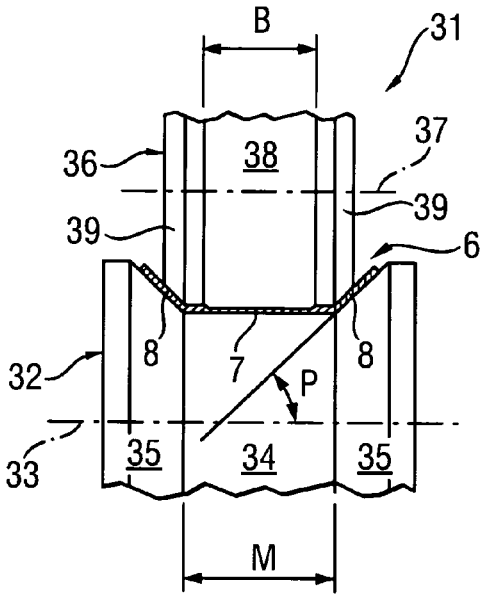
Figure 1C:
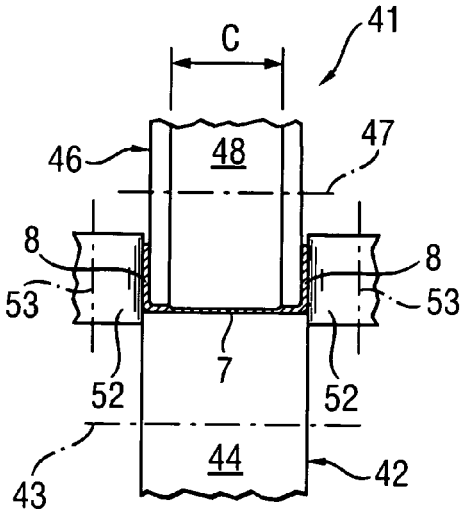
Figure 2:
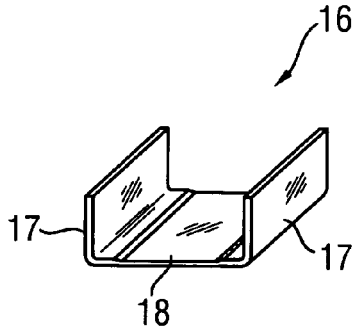
FIG. 2 a perspective view of a profile produced with the cold rolling method described with reference to FIGS. 1A-1C.
Figure 3A:
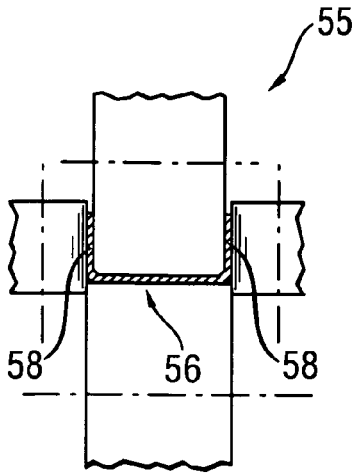
FIGS. 3A-3D schematic views of four, following one another separate steps of a second embodiment of a cold rolling method according to the present invention;.
Figure 3B:
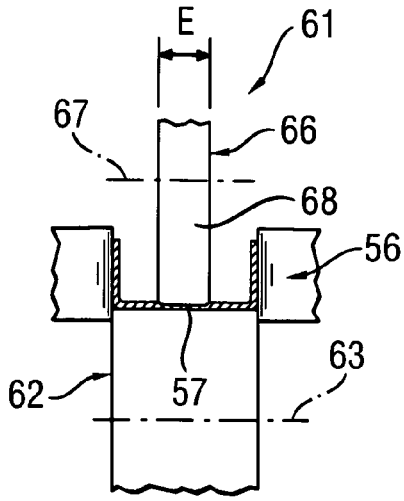
Figure 3C:
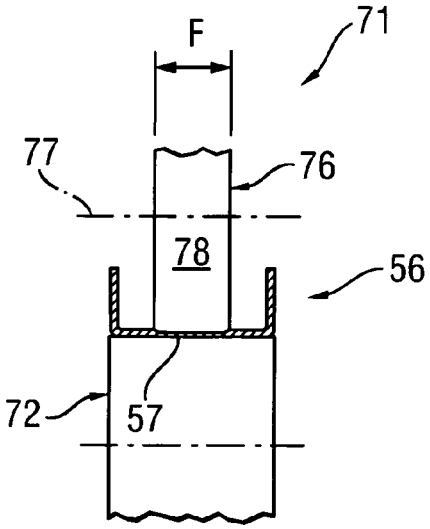
Figure 3D:
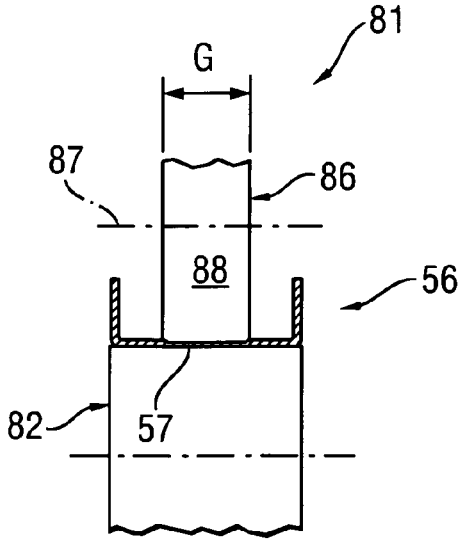

FIGS. 1A-1C show schematically three separate steps of a first embodiment of a cold rolling process according to the present invention for manufacturing a U-shaped profile 16, which is shown in FIG. 2, from a one-piece rolling stock in form of initial material 6. According to the inventive method of process, the initial material 6 is deformed, for reduction of its thickness in some regions, in the lateral direction, with laterally offset deforming regions 28, 38, 48 of following one another, in the material displacement direction, rolls 26, 36 46 which are formed as thickness reduction rolls and are used for deformation of the initial material 6.

Firstly, in a first station 21 of a rolling installation, a flat initial material 6 has its thickness reduced in its region 7 between a first counter-roll 22, which is rotatable about a rotational axis 23, and an opposite first roll 26 which is rotatable about a rotational axis 27 and has a deforming region 28 with a width A. The thickness reduction results in a certain widening of the initial material 6. The widening of the initial material 6 is carried out with the deforming region 28 of the roll 26 in a plane parallel to the rotational axis 27 or in the rolling stock plane in the direction of the rotational axis 27.

The first counter-roll 22 has a bearing region 24 that extends parallel to its rotational axis 23, and two outer support regions 25 inclined toward each other and extending each at an angle O to the rotational axis 23. The first roll 26 has two outer profiling regions 29 spaced from the deforming region 28 and extending parallel to the support region 25 of the counter-roll 22. The profiling regions 29 are inclined at approximately the same or the same angle as the support regions 25 of the counter-roll 22. In the alternative embodiment of the roll 26, not shown in the drawings, the deforming region extends up to the profiling regions. As a result of such formation of the counter-roll 22 and the roll 26, there are formed, in the initial material 6, two folded sections 8 extending in the rolling or longitudinal direction of the initial material 6. Simultaneously, a thickness reduction of the initial material 6 between the two folded sections 8 takes place in the initial phase of a multi-step cold rolling process. Thus, between the thickness-reduced region 7 and free edges 9 of the initial material 6, there are formed bends which form additional edges in the initial material 6 which are spaced from respective free edges 9.

In a further station 31, which is shown in FIG. 1B, the pre-profiled initial material 6, the thickness of which has already been reduced in some regions, is deformed further, with the thickness-reduced region 7 widening further. The further thickness reduction takes place between the second counter-roll 32 rotatable about a rotational axis 33, and an opposite second roll 36 rotatable about a rotational axis 37 and having a deforming region 38 with a width B.

The width B of the deforming region 38 of the second roll 36 is greater than the width A of the first roll 26. The deforming region 38 widens, with respect to the axis of symmetry of the rolls 26 and 36, which extends in the rolling direction of the initial material 6, and with respect to the deforming region 28 of the first roll 26, on both sides. Widening of the initial material 6 is affected with the deforming region 38 of the second roll 36 in a rolling stock plane in direction of the rotational axis 37.

The second counter-roll 32 has a bearing region 34 that extends parallel to its rotational axis 33 and the width M of which is the same as the width M of the bearing region 24 of the first counter-roll 22. The second counter-roll 32 further has two outer support regions 35 inclined toward each other and each extending at an angle P to the rotational axis 33. The support regions 35 are inclined toward each other at a steeper angle than the support regions 25 of the first counter roll 22 and, thus, angle P is greater than angle O at which the support regions 25 are inclined. The second roll 36 has two outer profiling regions 39 spaced from the deforming region 28 and extending parallel to the support regions 35 of the second counter-roll 32. The profiling regions 39 are inclined at approximately the same or the same angle as the support regions 35 of the second counter-roll 32. As a result, the folded sections 8 of the initial material 6, which form side walls 17 of the U-shaped profile 16, are inclined further toward the thickness-reduced region 7 and, thus, toward the bottom section 18 of the profile 16.

In the last station 41 which is shown in FIG. 1C, the pre-profiled initial material 6, the thickness of which has already been reduced in some regions, is deformed further, with the thickness-reduced region 7 being widened to the final dimension. The further widening of the initial material 6 takes place between the third counter-roll 42 rotatable about a rotational axis 43 and having a bearing region 44 extending parallel to the rotational axis 43, and an opposite third roll 46 rotatable about a rotational axis 47 and having a deforming region 48 with a width C. The width C of the deforming region 48 of the third roll 46 is greater than the width B of the deforming region 38 of the second roll 46, whereby the deforming region 48 further widens, with respect to the axis of symmetry of the rolls 26, 36, 46, which extends in the rolling direction of the initial material 6, and with respect to the deforming region 28 or 38 of the roll 26 or 36, on both sides. The widening of the initial material 6 is effected with the deforming region 48 of the third roll 46 in the rolling stock plane in direction of the rotational axis 47. In the station 41, there are further provided straightening rolls 52 rotational axis 53 of which extend perpendicular to the rotational axes 47 or 43 of the third roll 46 or the third counter-roll 42. The straightening rolls 52 finally deform the thickness-reduced and pre-deformed initial material 6 into the U-shaped profile 16 which is shown in FIG. 2 and consists of the bottom section 18 and side walls 17.

It should be clear that for carrying out the inventive cold rolling process, e.g., dependent on the initial thickness or the material characteristics of the initial material 6, or on a final shape of the profile, more than three stations of a rolling installation for manufacturing the profile may be necessary. According to the embodiment of the inventive method discussed above, the initial material 6 is widened, in the widening direction, on both sides. However, the widening can also take place only on one side, which can be advantageous, e.g., with a large dimension of the initial material in the widening direction or with formation of several thickness-reduced regions in the initial material simultaneously.

For the above-described cold-rolling process that is schematically shown in FIGS. 1A-1C, it is essential that the folded sections 8 are formed at the start of the cold-rolling process or during step-by-step widening of the initial material 6 by following each other, in the displacement direction of the initial material, rolls 26 and 36 having deforming regions 28 and 38, respectively, and in cooperation with counter-rolls 22 and 32, the rolls 26 and 36 deform the initial material 6 step-by-step to a desired profile shape. In an embodiment of the inventive method not shown in the drawings, the widening of the initial material 6 takes place in separate stations of the rolling installation, without further changing the folded sections 8.

In distinction from the previously described embodiment of the inventive cold rolling process, according to the embodiment of the inventive cold rolling process schematically illustrated in FIGS. 3A-3D, a single-piece rolling stock in form of an initial material 56 is preliminary bent, before the reduction of its thickness, in at least one profiling station 55 and, thus, in an initial phase of the cold rolling process, in a desired shape of the profile. In a further station 61 of the rolling installation, the initial material 56, which is already provided with two folded sections 56 extending in the rolling or longitudinal direction, has its thickness reduced in its region 57 between a counter-roll 62 rotatable about a rotational axis 63, and a roll 66 rotatable about a rotational axis 67 and having a deforming region 68. The thickness reduction of the initial material 56 takes place between the two folded sections 58 or between two lends of the initial material 56. In the embodiment discussed immediately above, the width E of the deforming region 68 of the roll 66 corresponds to the entire roll width.

In the following stations 71 and 81, the width F and G of the corresponding deforming regions 78 and 88 of the rolls 76 and 86 increases until a desired width of the thickness-reduced region 57 of the profiled and thickness-reduced initial material 56 is reached. During widening, the initial material 56 and the thickness-reduced region 57 is supported in the stations 71 and 81 by a cylindrical counter-roll 72 and 82, respectively.

The deforming regions 68, 78 and 88 of the rolls 66, 76 and 86 widen the initial material 56 in a plane parallel to the respective rotational axes 67, 77, 87 of the rolls 66, 76, and 86 or in the rolling stock plane in direction of the respective rotational axes 67, 77, 87.

A third embodiment of the inventive cold rolling process, the back-bending process, which is shown in FIGS. 4A-4D is a continuation of the process shown in FIGS. 1A-1B. The separate steps schematically shown in FIGS. 4A-4B represent reversal of steps 1B-1A of the first embodiment of the inventive cold rolling process. The pre-profiled initial material 6' that has a profile identical to the profile of the initial material 6 obtained in the step schematically shown in FIG. 1B is bent backward at a station 31', FIG. 4A, without widening further of the thickness-reduced region 7' of the profiled initial material 6'. The straightening of the profiled initial material 6' takes place between a counter-roll 32' rotatable about a rotational axis 33' and an opposite roll 36' rotatable about a rotational axis 37'.

The counter-roll 32' has a bearing region 34' that extends parallel to its rotational axis 33' and the width M' of which is the same as the width M of the bearing region 34 of the counter-roll 32 in FIG. 1B. The counter-roll 32' further has two outer support regions 35' inclined toward each other and each extending at an angle P' to the rotational axis 33'. The support regions 35' are rotatable about the rotational axis 33'. The opposite second roll 36' rotates about the rotational axis 37' and has an intermediate region 38 with a width B'. The width B' of the intermediate region 38 of the roll 36' is the same as that of the second roll 38 in FIG. 1B.

Upon rotation of the roll 36' and its gradual translational movement the angle P' is gradually reduced to an O' that corresponds to the angle O in FIG. 1A. Further straightening take place at the station 21' shown in FIG. 4B.

At the station 21', further straightening takes place between a counter-roll 22' rotatable about a rotational axis 23', and an opposite roll 26' which is rotatable about a rotational axis 27' and has an intermediate region has an A' identical to the width B' of the intermediate region 38' in FIG. 4B.

The counter-roll 22' has a bearing region 24' that extends parallel to its rotational axis 23', and two outer support regions 25' inclined toward each other and extending each at an angle O' to the rotational axis 23'. The roll 26' has two outer straightening regions 29' on opposite sides of the intermediate region 28 and extending parallel to the support regions 25' of the counter-roll 22'. The regions 29' are inclined at approximately the same or the same angle as the support regions 25' of the counter-roll 22'.

Upon rotation of the 26' and its gradual translational movement the pre-profiled initial material is straightened further.

Complete straightening takes place at the station 91 shown in FIG. 4C. The counter-roll 92 has a straight bearing region 94. The opposite roll 96 has two straightening regions 98 and an intermediate region 100 the width of which corresponds to the width B of the deforming region 38 in FIG. 1B. Upon rotational movement of the roll 98 about the axis 97, complete straightening is achieved.

Back-bending starts at station 101 shown in FIG. 4D. The station 101 includes a counter-roll 102 and bending roll 106. The counter-roll 102 has a bearing region 104 extending parallel to a rotational axis 103 and two support regions 112 arranged on opposite sides of the bearing region 104. The ending roll 106 has two outer profiling regions 108 arranged on opposite sides of the intermediate region 110 and extending parallel to the support region 12 of the counter roll 102. The profiling regions 108 are inclined at approximately the same angle as the support regions 112 of the counter-roll 106. The width of the intermediate region 110 corresponds to the width B of the deforming region 38 in

FIG. 1B.

As a result of such formation of the counter-roll 102 and the roll 106, there are formed, in the initial material 6', two folded sections 8' extending in the rolling or longitudinal direction of the initial material 6'.

The final shape of the formed profile takes place at a further station (not shown) which is a mirror image of the station 41 in FIG. 1C.

The produced profile 16' is shown in FIG. 5. The profile 16' is a mirror image of the profile 16 shown in FIG. 2. The profile 16' has a bottom section 18' and side walls 17'. However, in distinction from the profile 16 shown in FIG. 2, in the profile 16' shown in FIG. 5, the thickness-reducing recess in formed in the outer surface of the bottom 16 and not in the inner surface as in profile shown in FIG. 2.

Though the present invention was shown and described with references to the preferred embodiments, such are merely illustrative of the present invention and is not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A cold rolling method for manufacturing a profile (16) from a one-piece rolling stock in form of initial material (6; 56), comprising the steps of:

providing a plurality of rolls (26, 36, 46; 66, 76, 86) each having a deforming region (28, 38, 48; 68, 78, 88) for deforming the initial material (6; 56);

bending the initial material (6; 56) in a first direction with formation at least one upwardly extending folded section (8) extending in a rolling direction of the initial material (6; 56); and deforming the initial material (6; 56) in a width direction of the initial material (6; 56) with reduction of thickness thereof at least in one region, back-bending the folded section in a second direction opposite the first direction until the folded section (8) is flattened;

further bending the folded section (8) from a flattened position thereof in the second direction, so that the folded section extends downwardly; and forming the initial material with the downwardly extending back bent folded section in a profile by further bending the folded section in the second direction.

2. A cold rolling method according to claim 1, wherein the bending step includes bending the initial material (6; 56) in a first step, and deformation of the initial material (6; 56) in the width direction thereof is effected thereafter.

3. A cold rolling method according to claim 1, wherein the bending step and the deforming step are carried out simultaneously.

4. A cold rolling method according to claim 1, wherein the deforming step includes deforming the initial material (6; 56) in the width direction thereof is effected with sidewise offset deforming regions (28, 38, 48; 68, 78, 88) of following each other, in the rolling direction of the initial material (6; 56), rolls (26, 36, 46; 66, 76, 86).

5. A cold rolling method according to claim 1, wherein the bending step includes bending of the initial material (6; 56) in the profile stepwise from a roll (26, 36, 46; 66, 76, 86) to a roll (36, 46, 76, 86).

* * * * *